US010596586B2

(12) United States Patent
Rick

(10) Patent No.: US 10,596,586 B2
(45) Date of Patent: Mar. 24, 2020

(54) DEVICE FOR RECOVERING ENERGY FROM EXHAUST AIR

(71) Applicant: Ford Global Technologies, LLC, Dearborn, MI (US)

(72) Inventor: Manfred Rick, Köln (DE)

(73) Assignee: Ford Global Technologies, LLC, Dearborn, MI (US)

( * ) Notice: Subject to any disclaimer, the term of this patent is extended or adjusted under 35 U.S.C. 154(b) by 4 days.

(21) Appl. No.: 15/463,076

(22) Filed: Mar. 20, 2017

(65) Prior Publication Data

US 2017/0266685 A1 Sep. 21, 2017

(30) Foreign Application Priority Data

Mar. 18, 2016 (DE) ..... 10 2016 204 510

(51) Int. Cl.
*B05B 16/60* (2018.01)

(52) U.S. Cl.
CPC ..... *B05B 16/60* (2018.02)

(58) Field of Classification Search
CPC ..... B05B 16/00; B05B 15/12; B05B 16/60; F25B 41/04; F25B 41/003; F25B 49/02; F25B 2400/04; F25B 30/02; F25B 1/00; F28D 7/04; F28D 7/12; F28D 21/0012; F28D 15/00
See application file for complete search history.

(56) References Cited

U.S. PATENT DOCUMENTS 4,173,924 A * 11/1979 Bradshaw ..... B05B 16/60 454/52
4,367,787 A * 1/1983 Bradshaw ..... F24F 3/14 165/222
4,494,596 A * 1/1985 Bradshaw ..... F24F 3/14 165/101
4,510,763 A * 4/1985 Johnson ..... H01H 35/2657 200/83 P
5,067,330 A * 11/1991 Cook ..... F25B 15/008 62/485
6,205,811 B1 * 3/2001 d'Alencon ..... B01D 3/007 62/185

(Continued)

FOREIGN PATENT DOCUMENTS

DE 2922179 12/1980
DE 3222406 12/1983

(Continued)

*Primary Examiner* — Melvin Jones
(74) *Attorney, Agent, or Firm* — Burris Law, PLLC

(57) ABSTRACT

There is provided an energy recovery device for recovering energy from exhaust air which flows through a discharge line. The energy recovery device includes a heat exchanger device having at least a first heat exchanger unit and a heat pump, wherein the heat pump is connected at the high-temperature side thereof to the first heat exchanger unit and is arranged at the low-temperature side thereof in the exhaust air flow in the exhaust air flow direction downstream of the first heat exchanger unit or is connected at the low-temperature side thereof to a second heat exchanger unit which is connected downstream of the first heat exchanger unit in the exhaust air flow direction.

20 Claims, 1 Drawing Sheet

(56) References Cited

U.S. PATENT DOCUMENTS

| | | | | |
|---|---|---|---|---|
| 7,434,415 | B2 * | 10/2008 | Knight | F24F 3/153 236/46 C |
| 2008/0141705 | A1 * | 6/2008 | Eisenhour | F25B 11/02 62/498 |
| 2012/0017635 | A1 * | 1/2012 | Eisenhour | F25B 9/06 62/498 |
| 2012/0047923 | A1 * | 3/2012 | Wintemute | F24F 1/022 62/91 |
| 2013/0056177 | A1 * | 3/2013 | Coutu | F28D 19/042 165/96 |
| 2014/0311709 | A1 * | 10/2014 | Chan | F28D 1/05316 165/104.11 |

FOREIGN PATENT DOCUMENTS

| | | |
|---|---|---|
| DE | 3518143 | 11/1986 |
| DE | 3837133 | 4/1990 |
| FR | 2967486 | 5/2012 |
| GB | 2052704 | 1/1981 |
| WO | 2010102606 | 9/2010 |

* cited by examiner

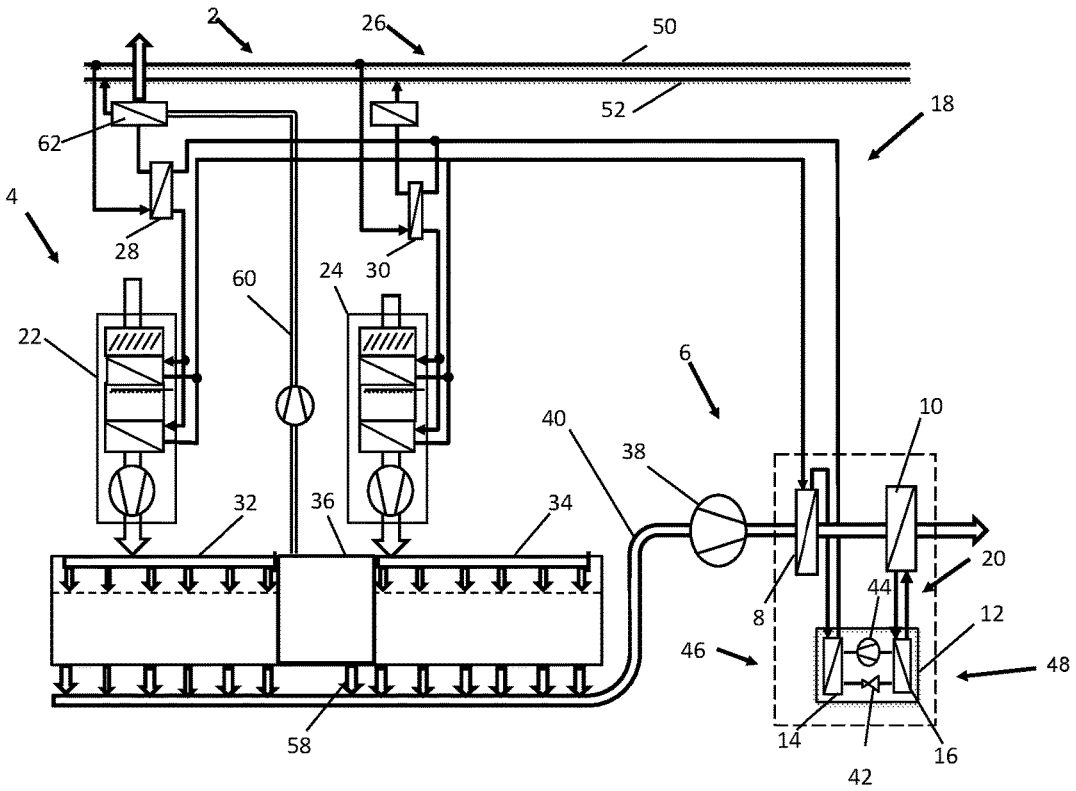
2
26
50
52
18
62
4
28
30
60
24
22
6
10
40
38
32
36
34
20
44
8
12
46
48
58
14
16
42

DEVICE FOR RECOVERING ENERGY FROM EXHAUST AIR

CROSS-REFERENCE TO RELATED APPLICATIONS

This application claims priority to and the benefit of DE 102016204510.5 filed on Mar. 18, 2016. The disclosure of the above application is incorporated herein by reference.

FIELD

The present disclosure relates to a device for recovering energy from exhaust air and a painting installation having such a device.

BACKGROUND

The statements in this section merely provide background information related to the present disclosure and may not constitute prior art.

A painting cabin of a painting installation is generally supplied with clean fresh air which is brought in an air preparation installation to a temperature which is predetermined by the respective paint supplier of, for example, 20±2° C. and a predetermined air humidity of, for example, 65±3%. Exhaust air is drawn away together with free-floating paint particles. The exhaust air is cleaned in respect of the paint particles and other dirt. The exhaust air generally has a temperature of 20° C. and an air humidity of 70%. It is drawn in by fans and is discharged from the building of the painting installation. In this instance, however, the thermal energy of the exhaust air remains unused, wherein known devices for recovering energy from exhaust air require minimum temperatures of 70° C.

SUMMARY

The present disclosure provides a device for recovering energy from exhaust air of a painting installation, which in one form is achieved by an energy recovery device for recovering energy from exhaust air which flows through a discharge line. The energy recovery device comprises a heat exchanger device having at least a first heat exchanger unit and a heat pump. The heat pump is connected at the high-temperature side thereof to the first heat exchanger unit. At the low-temperature side thereof, the heat pump is arranged in the exhaust air flow in the exhaust air flow direction downstream of the first heat exchanger unit or is connected to a second heat exchanger unit which is connected downstream of the first heat exchanger unit in the exhaust air flow direction. Consequently, the heat pump is acted on with the temperature difference which decreases at the exhaust air flow or the second heat exchanger unit. This temperature difference is raised by the heat pump to a higher temperature level. If the heat pump is connected to a second heat exchanger unit which is connected downstream of the first heat exchanger unit in the exhaust air flow direction, the thermal energy which is recovered with the second heat exchanger unit is supplied to the thermal energy recovered from the first heat exchanger unit and supplied, for example, to a water circuit. Energy can thus be recovered from the exhaust air of a painting installation.

According to one form, a water circuit of the heat exchanger device connects the first heat exchanger unit to a condenser of the heat pump of the heat exchanger device. Consequently, water which in the heat exchanger unit has discharged its thermal energy to the air which is intended to be supplied to the painting installation first flows through the first heat exchanger unit in which it again absorbs thermal energy from the exhaust air in order to then flow through the condenser of the heat pump and to be heated up here again.

According to another form, the heat exchanger device comprises a secondary water circuit which connects the second heat exchanger unit to an evaporator of the heat pump. In the secondary circuit, there thus circulates a second quantity of water which is separate from the first quantity of water which is circulating in the water circuit. The second quantity of water absorbs when passing through the second heat exchanger residual thermal energy from the exhaust air and supplies it to the evaporator.

According to another form, the first heat exchanger unit of the heat exchanger device is a recuperator. Recuperators have a separate space for each of the two media and consequently enable in contrast to regenerators a continuous and rapid thermal energy transfer.

According to another form, the water circuit connects the first heat exchanger unit of the heat exchanger device to at least a first air discharge device. Consequently, water, after it has discharged its thermal energy to the air which is intended to be supplied to the painting installation, is supplied to the first heat exchanger unit.

According to another form, a heat exchanger which is connected to a thermal energy supply system is associated with the at least first air discharge device. The heat exchanger may be a plate heat exchanger. As a result of this heat exchanger, thermal energy can additionally be removed from the thermal energy supply system in order to reach a predetermined temperature, even when the thermal energy recovered is not sufficient for this purpose, for example, when the fresh air drawn in is particularly cold as a result of low outside temperatures.

According to another form, the energy recovery device comprises a dryer exhaust air line for hot exhaust air of at least one of the dryer units. In this instance, the dryer exhaust air line of at least one of the dryer units may open in the discharge line so that at least a portion of the exhaust air which is produced at the drying units of the painting installation is added to the exhaust air from the painting cabins in order to provide this energy to the heat exchanger device. Additionally or alternatively, a heat exchanger may be arranged in the dryer exhaust air line of at least one of the dryer units. In this instance, a return line of at least one plate heat exchanger may further be connected to the heat exchanger.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1 is a schematic view of a painting installation with a device according to the present disclosure for recovering energy from exhaust air.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, a painting installation 2, for example, for painting motor vehicle bodyworks is illustrated.

The painting installation 2 has in the present form a first painting station 32 and a second painting station 34 and a drying station 36 which is arranged between the first painting station 32 and the second painting station 34.

An air preparation installation 4 draws in fresh air from the environment and guides it to the first painting station 32 and the second painting station 34. In order to heat the fresh air to a predetermined temperature of, for example, 20±2° C., the air preparation installation 4 has in the present form a first air discharge device 22 and a second air discharge device 24, wherein the first air discharge device 22 supplies the first painting station 32 and the second air discharge device 24 supplies the second painting station 34 with fresh air.

In order to transfer thermal energy to the air which is intended to be discharged, the first air discharge device 22 and the second air discharge device 24 have, for example, in each case heat exchangers which—as will be described below in greater detail—are supplied with thermal energy from a thermal energy supply system 26.

Exhaust air from the first air discharge device 22 and the second air discharge device 24 is drawn off together with free-floating paint particles by a fan 38 and supplied via a discharge line 40 for exhaust air to a heat exchanger device 6 of an energy recovery device for recovering energy from exhaust air. In this instance, the exhaust air is filtered by means of filters (not illustrated) before it enters the heat exchanger device 6.

The heat exchanger device 6 has in the present form a first heat exchanger unit 8 and a second heat exchanger unit 10 and a heat pump 12 having a condenser 14, an evaporator 16, a throttle 42 and a compressor 44.

In the exhaust air flow direction of the exhaust air, in the present form the first heat exchanger unit 8, in the present form a recuperator, is arranged upstream of the second heat exchanger unit 10. That is to say, the first heat exchanger unit 8 and the second heat exchanger unit 10 are connected in series, wherein an exhaust air outlet of the first heat exchanger unit 8 is connected to an exhaust air inlet of the second heat exchanger unit 10.

A water circuit 18 connects the first air discharge device 22 and second air discharge device 24 which are connected in parallel in the present form to an input of the first heat exchanger unit 8, whilst an outlet of the first heat exchanger unit 8 is connected to the condenser 14 of the heat pump 12. The water circuit 18 continues from the condenser 14 to a first heat exchanger 28 and a second heat exchanger 30 and then terminates in each case in a return line 52 of the thermal energy supply system 26.

The first heat exchanger 28 and the second heat exchanger 30 are each connected to a supply line 50 of the thermal energy supply system 26. From the first heat exchanger 28 and the second heat exchanger 30, there extend lines in each case to the first air discharge device 22 and the second air discharge device 24.

A secondary water circuit 20, which is separate from the water circuit 18, connects the second heat exchanger unit 10 to the evaporator 16 of the heat pump 12 in the present form.

Consequently, the secondary water circuit 20 connects a low-temperature side 48 of the heat pump 12 to the second heat exchanger unit 10, whilst the water circuit 18 connects a high-temperature side 46 of the heat pump 12 to the first heat exchanger unit 8. In this instance, the low-temperature side 48 is intended to be understood to be the portion of the heat exchanger 12 in which the coolant which is circulating in the heat pump 12 is in the liquid aggregate state, whilst the high-temperature side 46 is intended to be understood to be the portion of the heat exchanger 12 in which the coolant which is circulating in the heat pump 12 is in the gaseous aggregate state. That is to say, the low-temperature side 48 is located in the flow direction of the coolant between a throttle 42 and a compressor 44 of the heat pump 12, whilst the high-temperature side 46 is located in the flow direction of the coolant between the compressor 44 and the throttle 42.

During operation, exhaust air is drawn in by the fan 38 and directed through the first heat exchanger unit 8. As a result of the flow of liquid flowing back from the first air discharge device 22 and second air discharge device 24, respectively, a first portion of the thermal energy of the discharge air is taken up and is transported onward to the condenser 14 of the heat pump 12.

The exhaust air then reaches the second heat exchanger unit 10 in which liquid of a secondary water circuit 20 absorbs a second portion of the thermal energy of the exhaust air which has now already cooled. This second portion of the thermal energy is transported to the evaporator 16 of the heat pump 12. The heat pump 12 brings the second portion of the thermal energy to a temperature level which enables the second portion of the thermal energy to be combined with the first portion of the thermal energy.

The combined thermal energy is then, for example, directed through warm water at 55° C. through the first heat exchanger 28 and the second heat exchanger 30 which thus heats water from the supply line 50 of the thermal energy supply system 26 to a temperature of, for example, from 70° C. to 90° C., which is then supplied to the first air discharge device 22 and second air discharge device 24 in order to heat the air to a temperature of 20±2° C.

The hot exhaust air (exhaust gas) occurring in the dryer 36 can be connected by means of a separate exhaust air line 58 (dryer exhaust air line) directly to the discharge line 40 so that at least a portion of the exhaust air which is produced in the dryer 36 is added to the exhaust air from the painting station 32, 34 in order to provide this energy to the heat exchanger device 6.

As an alternative to this arrangement, there may be arranged in the exhaust air line 60 (dryer exhaust air line) of the dryer 36 a heat exchanger 62 which is connected to the return of the plate heat exchanger 28, 30. The exhaust air line 60 does not necessarily open in the discharge line 40 in this instance. The energy discharged in the plate heat exchangers 28, 30 is thereby at least partially replaced from the exhaust air of the dryer 36 again.

With the energy recovery device according to the present disclosure for recovering energy from exhaust air, the energy requirement of a painting installation can be reduced.

The present disclosure has been described in detail with reference to an form for the purposes of illustration. However, deviations from the form are possible. For example, in the form described, the low-temperature side 48 of the heat pump 12 is connected to the second heat exchanger unit 10. However, it is also possible to arrange the low-temperature side 48 of the heat pump 12 in the exhaust air flow in the exhaust air flow direction downstream of the first heat exchanger unit 8. The second heat exchanger unit 10 then does not need to be present. It is also possible for a plurality of dryers to be available. The exhaust air lines 58 of all the dryers 36 can then open in the discharge line 40. Alternatively, it is possible for the exhaust air lines 60 of all the dryers 36 not to open in the discharge line 40 and for there to be arranged in the exhaust air lines 60 heat exchangers 62 which are connected to the return of the plate heat exchangers 28, 30. Furthermore, it is possible for the exhaust air lines 58 of a portion of the dryer 36 to open in the discharge line 40 and for the exhaust air lines 60 of another portion of the dryer 36 not to open in the discharge line 40, wherein heat exchangers 62 which are connected to the return of the plate heat exchangers 28, 30 are arranged in the exhaust air lines 60 which do not open in the discharge line 40. A person skilled in the art thus recognizes that deviations from the form are possible and that the present disclosure is not intended to be limited to the form, but instead only by the appended claims.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An energy recovery device for recovering energy from exhaust air which flows through a discharge line, the device comprising:

a heat exchanger device including a first heat exchanger unit, a second heat exchanger unit, and a heat pump, wherein:

the first heat exchanger unit and the second heat exchanger unit are arranged along an exhaust air flow direction of the discharge line with the second heat exchanger unit being downstream of the first heat exchanger unit, such that the exhaust air flows from the discharge line through the first heat exchanger unit and the second heat exchanger unit and exists from an outlet of the second heat exchanger unit.

a high-temperature side of the heat pump is connected to the first heat exchanger unit and the heat pump is arranged at a low-temperature side of the exhaust air flow direction downstream of the first heat exchanger unit; and a low-temperature side of the heat pump is connected to the second heat exchanger unit, a first portion of heat being removed from the exhaust air in the first heat exchanger to the high-temperature side of the heat pump, a second portion of heat being removed from the exhaust air in the second heat exchanger to the low-temperature side of the heat pump.

2. The energy recovery device according to claim 1, wherein a water circuit connects the first heat exchanger unit of the heat exchanger device to a condenser of the heat pump of the heat exchanger device.

3. The energy recovery device according to claim 2, wherein the water circuit connects the first heat exchanger unit of the heat exchanger device to at least a first air discharge device.

4. The energy recovery device as claimed in claim 3, wherein a heat exchanger connected to a thermal energy supply system is operatively connected with the at least first air discharge device.

5. The energy recovery device according to claim 1, wherein the heat exchanger device comprises a secondary water circuit which connects the second heat exchanger unit to an evaporator of the heat pump.

6. The energy recovery device according to claim 1, wherein the first heat exchanger unit of the heat exchanger device is a recuperator.

7. The energy recovery device according to claim 1 further comprising a dryer exhaust air line for hot exhaust air of at least one dryer unit.

8. The energy recovery device according to claim 7, wherein the dryer exhaust air line of the at least one dryer unit opens in the discharge line.

9. The energy recovery device according to claim 7, wherein a heat exchanger is arranged in the dryer exhaust air line of the at least one dryer unit.

10. The energy recovery device according to claim 9, wherein a return line of at least one plate heat exchanger is connected to the heat exchanger.

11. A painting installation having an energy recovery device according to claim 1.

12. The energy recovery device according to claim 1, wherein the heat pump includes a condenser that is connected to the first heat exchanger unit and an evaporator that is connected to the second heat exchanger unit.

13. A system comprising:

the energy recovery device according to claim 1;

a water circuit;

a first air discharge device; and a second air discharge device, wherein the water circuit is configured to connect an input of the first heat exchanger unit to the first and second air discharge devices and connect an output of the first heat exchanger unit to a condenser of the heat pump.

14. An energy recovery device for recovering energy from exhaust air that flows through a discharge line, the device comprising:

a heat exchanger device including a first heat exchanger unit, a second heat exchanger unit, and a heat pump, wherein:

the first heat exchanger unit and the second heat exchanger unit are arranged along an exhaust air flow direction of the discharge line with the second heat exchanger unit being downstream of the first heat exchanger unit, the first heat exchanger unit having an exhaust air inlet connected to the discharge line and an exhaust air outlet connected to the second heat exchanger unit, the first heat exchanger unit is configured to receive fluid from a first air discharge device and a second air discharge device, the heat pump is arranged at a low-temperature side of the exhaust air flow downstream of the first heat exchanger unit, and a high-temperature side of the heat pump is connected to the first heat exchanger unit; and a low-temperature side of the heat pump is connected to the second heat exchanger unit, a first portion of heat being removed from the exhaust air in the first heat exchanger unit to the high-temperature side of the heat pump, a second portion of heat being removed from the exhaust air in the second heat exchanger to the low-temperature side of the heat pump.

15. The energy recovery device according to claim 14, wherein the heat pump includes a condenser that is connected to the first heat exchanger unit and an evaporator that is connected to the second heat exchanger unit.

16. The energy recovery device according to claim 14, wherein:

the first heat exchanger unit is connected to the first air discharge device, the second air discharge device, and the heat pump by way of a first water circuit, and the second heat exchanger is connected to the heat pump by way of a second water circuit separate from the first water circuit.

17. An energy recovery device for recovering energy from exhaust air comprising:

a heat exchanger device including:

a first and second heat exchanger units arranged along an exhaust air flow direction of a discharge line with the second heat exchanger unit being downstream of the first heat exchanger unit, the exhaust air flowing from the first heat exchanger unit to the second heat exchanger unit and exiting from an outlet of the second heat exchanger unit, and a heat pump connected to an output of the first heat exchanger unit and to an input and an output of the second heat exchanger unit, a first portion of heat being removed from the exhaust air in the first heat exchanger unit to the high-temperature side of the heat pump, a second portion of heat being removed from the exhaust air in the second heat exchanger unit to a low-temperature side of the heat pump.

18. The energy recovery device according to claim 17, wherein the heat pump includes a condenser that is connected to the first heat exchanger unit and an evaporator that is connected to the second heat exchanger unit.

19. The energy recovery device according to claim 17, wherein a high-temperature side of the heat pump is connected to the first heat exchanger unit, and the low-temperature side of the heat pump is connected to the second heat exchanger unit.

20. The energy recovery device according to claim 17, wherein:

the first heat exchanger unit is configured to receive fluid from a first air discharge device and a second air discharge device by way of a first water circuit, and the second heat exchanger is connected to the heat pump by way of a second water circuit separate from the first water circuit.

* * * * *